United States Patent [19]

Ober

[11] 4,418,375

[45] Nov. 29, 1983

[54] SOLID STATE IGNITION SYSTEM

[75] Inventor: John W. Ober, Hiram, Ohio

[73] Assignee: Hunter Investment Company, Solon, Ohio

[21] Appl. No.: 291,069

[22] Filed: Aug. 7, 1981

[51] Int. Cl.[3] ..... F23Q 3/00

[52] U.S. Cl. ..... 361/253; 315/209 T; 315/219

[58] Field of Search ..... 361/253, 256, 263; 315/209 R, 209 T, 219, 225

[56] References Cited

U.S. PATENT DOCUMENTS

| | | | |
|---|---|---|---|
| 3,260,299 | 7/1966 | Lister | 158/28 |
| 3,318,358 | 5/1967 | Potts | 158/28 |
| 3,377,998 | 4/1968 | Adams et al. | 315/209 R |
| 3,428,823 | 2/1969 | Pinckaers | 307/106 |
| 3,463,963 | 8/1969 | Fairley et al. | 315/206 |
| 3,718,423 | 2/1973 | Matthews | 431/264 |
| 3,877,864 | 4/1975 | Carlson | 431/264 |
| 4,051,827 | 10/1977 | Capurka et al. | 123/148 |
| 4,138,977 | 2/1979 | Grather et al. | 315/209 R |
| 4,167,767 | 9/1979 | Courier de Méré | 361/256 |
| 4,327,310 | 4/1982 | Jörg | 361/253 |

*Primary Examiner*—C. C. Shaw

*Attorney, Agent, or Firm*—Fay & Sharpe

[57] ABSTRACT

The solid state ignition system accurately controls the maximum primary winding current over a large range of operating voltages and selectively reduces its power consumption in response to a preselected ignition condition. The system includes an ignition transformer having a primary winding connected in series with a current regulator and a secondary winding connected with an igniter device for igniting an air-fuel mixture. A Darlington transistor is connected in series with the primary winding for blocking and permitting the flow of electrical current through the primary winding. A current regulating oscillator which controls the Darlington transistor alternately causes the transistor to be biased conductive and nonconductive. A comparator which is connected with the current sensor for sensing the primary winding current compares the sensed primary current with a preselected current. In response to the sensed current meeting or exceeding the preselected current, the comparator causes the current regulating oscillator to cause the transistor to block current flow. A current reducing circuit is connected with the current regulating oscillator to cause the current regulating oscillator to hold the transistor nonconductive intermittently in response to a sensed combustion condition. In this manner, the primary winding current is limited to a preselected magnitude without regard to the magnitude of the voltage from the voltage regulator and the average primary winding current is reduced in response to the combustion condition.

17 Claims, 4 Drawing Figures

SOLID STATE IGNITION SYSTEM

BACKGROUND OF THE INVENTION

This application pertains to the art of ignition systems and more particularly to multi-power ignition systems. The invention is particularly applicable to ignitions for mobile heaters and will be described with particular reference thereto. It is to be appreciated, however, that the invention has broader applications such as ignition systems for water heaters, internal or external combustion engines, and the like.

Heretofore, ignition circuits have commonly included a silicone controlled rectifier (SCR) or other solid state switching devices in series with the primary winding of an ignition transformer to control the flow of current therethrough. Commonly, an oscillator or alternating power source forward and reverse biased the switching device such that a series of current pulses or oscillating current flowed through the primary winding. The secondary winding of the ignition transformer was connected with an ignition device for producing a corresponding series of electric discharges to ignite an air-fuel mixture.

For some applications, it is desirable to change the amount of power across the ignition device automatically in response to a preselected condition. Heretofore, to change the amount of power, an appropriate condition sensor was commonly connected with the gate electrode of the SCR or other solid state switching device to adjust its threshold voltage.

In heaters, particularly mobile heates, the ignition circuit is often powered by a battery. For example, supplemental heaters for trucks are often connected with the truck's battery. When the engine is not running, the supplemental heater draws power from the battery discharging it. In very cold climates where supplemental heaters are most needed to keep the contents of the truck or the engine of the truck warm, the truck battery tends to become discharged more quickly.

SUMMARY OF THE INVENTION

The present invention contemplates a new and improved ignition system which overcomes the above problems and others. Yet, it reduces battery drain while maintaining the power in each spark substantially constant.

In accordance with one aspect of the present invention, there is provided an ignition system which includes an ignition transformer, a switching means, a current sensing means and a comparing means. A primary winding of the ignition transformer is adapted to be connected with the power supply and a secondary winding is adapted to be connected with an ignition device. The switching means has current blocking and permitting states for blocking and permitting a flow of electrical current through the primary winding. The current sensing means senses the magnitude of the primary winding current. The comparing means which compares the sensed current magnitude with a preselected current magnitude is operatively connected with the switching means to cause it to assume its current blocking state in response to the sensed current magnitude meeting or exceeding the preselected current magnitude.

In accordance with another aspect of the invention, there is provided an ignition system which includes an ignition transformer, a switching means, a current regulating means, and an average current reducing means. The ignition transformer has a primary winding which is adapted to be connected with a power supply and a secondary winding is adapted to be connected with an ignition device. The switching means which has current flow blocking and permitting states selectively blocks and permits current to flow through the primary winding. The current regulating means alternately assumes a first state in which it causes the switching means to assume its blocking state and a second state in which it causes the switching means to assume its permitting state. The average current reducing means, which is adapted to be connected with an ignition condition sensing means, intermittently causes the switching means to assume its blocking state in response to the sensed ignition condition.

One of the advantages of the present invention is that it accurately controls the maximum primary winding current over a range of operating voltages.

Another advantage of the present invention is that it reduces its power consumption in response to a preselected ignition condition.

Other advantages will become apparent to those of ordinary skill in the art upon reading and understanding the following detailed description.

BRIEF DESCRIPTION OF THE DRAWINGS

The invention may take form in various parts and arrangements of parts. The figures are only to illustrate a preferred circuit for implementing the present invention and are not to be construed as limiting the invention.

FIGS. 2A, B, and C illustrate the electrical outputs of various components of the circuit of FIG. 1.

DETAILED DESCRIPTION OF THE PREFERRED EMBODIMENT

Figure 1:
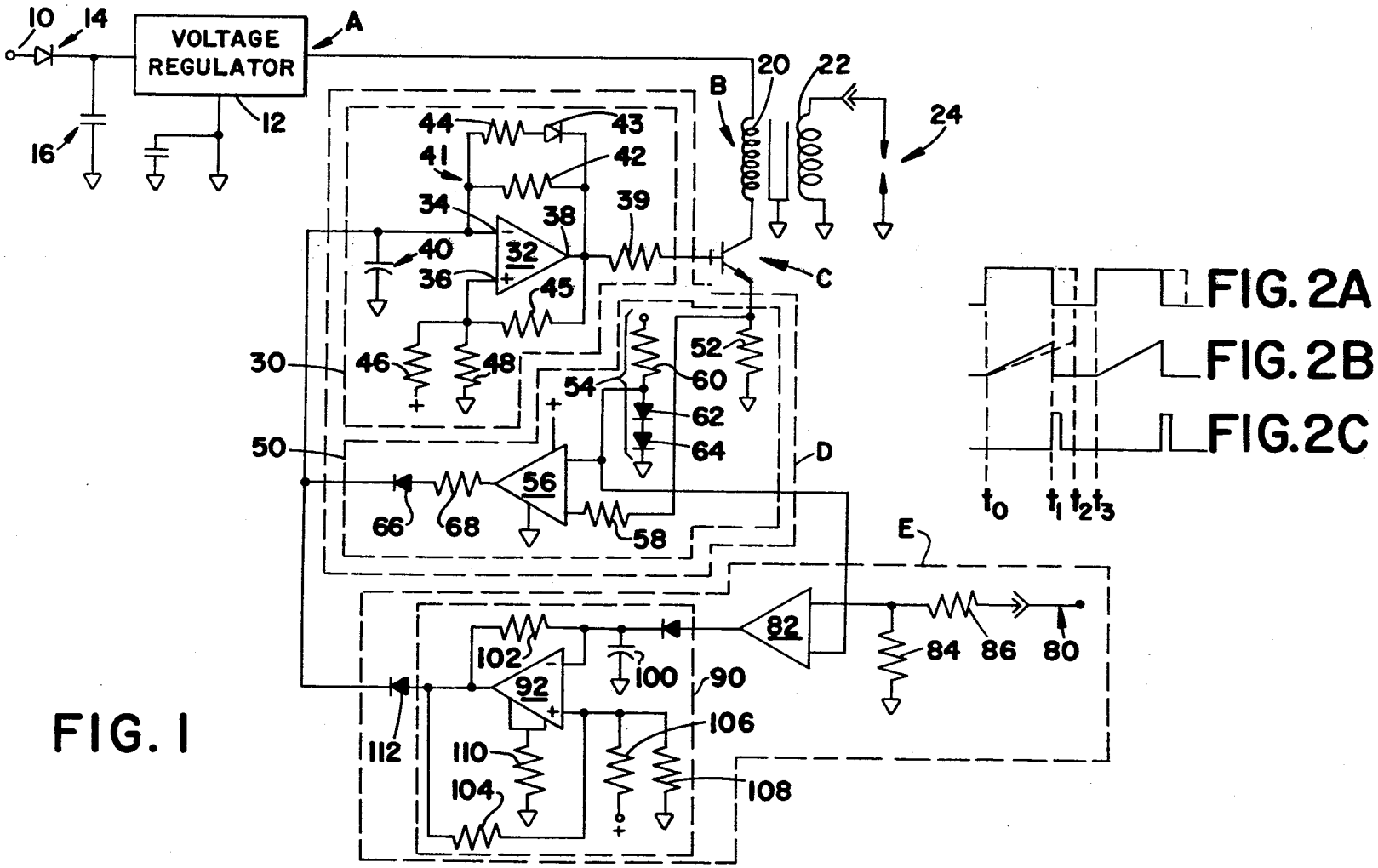
FIG. 1 is a circuit diagram of an ignition system in accordance with the present invention.

The ignition system includes a power supply A for supplying electrical potential to an ignition transformer B. A switching means C which has at least a conductive or current permitting state and a nonconductive or current blocking state selectively blocks and permits the flow of electric current through the ignition transformer. A current regulating means D controls the switching means C to regulate the current flowing through the ignition transformer B. An average current reducing means E selectively reduces the average current flowing through the ignition transformer. The current reducing means is responsive to a preselected ignition condition to cause the ignition current to be varied at least between a higher and a lower average ignition current.

The power supply A has a lead or jack 10 which is adapted to be connected with a positive terminal of a battery or other voltage source. A voltage regulator 12 regulates the voltage received on lead 10 such that the power supply produces a constant voltage output even if the voltage received on lead 10 varies. To be compatible with automotive batteries, the voltage supply A, in the preferred embodiment, produces an output potential of 10 volts DC. Other voltages may, of course, be selected, but care should be taken to select a voltage which is sufficiently high that the ignition system reliably produces an ignition spark. A diode 14 is connected between the lead 10 and the voltage regulator 12 to provide reverse polarity protection.

The ignition transformer B includes a primary winding 20 which is connected with the power supply A and a secondary winding 22 which is connected with an ignition device 24, such as an igniter, spark plug, or the like. In the preferred embodiment, the ignition transformer has a primary to secondary winding turn ratio of about 76:7000. It is to be appreciated, however, that other turn ratios may be selected to match the voltage output of the power supply A with the requirements of the particular ignition device which is selected.

The switching means C is connected in series with the primary winding 20, the voltage supply A, and ground. The switching means C is a solid state switching device which has at least a conductive, current flow permitting state and a nonconductive, flow blocking state which are assumed in response to being appropriately biased. Optionally, the switching means may have one or more intermediate states between its fully conductive and nonconductive states and may even be continuously variable. A satisfactory switching means is a 12 amp, 100 volt MPS A-13 Darlington transistor. However, other switching means which are capable of functioning under the current and voltage parameters of the ignition transformer, the selected power supply, and selected igniter may also be utilized.

The current regulating means D includes a current regulating oscillator means 30 for alternately assuming first and second states with a first frequency or periodicity. In the first state, the current regulating oscillator means 30 produces a first output which is appropriate to bias the switching means to its nonconductive or current blocking state and, in its second state, produces a second output which is appropriate to bias the switching means to its conductive or current permitting state. The oscillator means 30 includes a high gain amplifier 32 which is utilized as a free running oscillator, in the preferred embodiment, that has an on:off duty cycle of about 2:1 and a frequency of 4 kilohertz. The high gain amplifier 32 has a negative reference input 34, a positive reference input 36, and an output 38 which is connected with the base of the Darlington transistor by a resistor 39. When the magnitude of the potential received on the negative reference input 34 exceeds the potential received on the positive reference input 36, the signal produced on the amplifier output 38 is low, i.e., the current regulating oscillator means assumes its first state. When the potential received on the positive reference input 36 exceeds the potential received on the negative reference input 34, the signal on the amplifier output 38 is high, i.e., the current regulating oscillator means assumes its second state.

The potential received at the negative reference input 34 is controlled by capacitor 40. A negative feedback path 41 which includes a resistor 42 connected in parallel with a resistor 43 and diode 44 is connected between the amplifier output 38 and the capacitor 40. When the current regulating oscillator means is in its second state, a portion of the high output on amplifier output 38 is fed back by resistor 42 to raise the charge or potential across capacitor 40. When the potential on capacitor 40 exceeds the potential received by the positive reference input 36, the current regulating oscillator means 30 switches to its first state and its output goes low. The low output draws the charge from capacitor 40 through the negative feedback path 41. When the potential on capacitor 40 falls below the potential received at positive reference input 36, the current regulating oscillator means reverts to its second state. In this manner, the RC time constant of the capacitor 40 and the negative feedback path 41 determines the frequency of the current regulating oscillator means. The potential received by the positive reference input 36 is determined by a positive feedback resistor 45 connected between the amplifier output 38 and input 36 and by a voltage divider formed of resistors 46 and 48. When the current regulating oscillator means 30 switches between its first and second states, a portion of the low and high outputs is fed back by positive feedback resistor 45. This feedback changes the potential received by positive reference potential input 36 by a corresponding amount. This change in potential determines the change of potential which is required on capacitor 40 to cause the current regulating oscillator means 30 to switch states. In this manner, the positive feedback resistor 45 determines the rate of change of the current regulating oscillator means 30.

The current regulating means D further includes a current limiting means 50 for limiting the primary winding current to a preselected maximum. The current limiting means includes a current sensing means 52, a preselected reference current means 54, and a comparing means 56. The current sensing means 52 senses the actual primary winding current magnitude. In the preferred embodiment, the current sensing means is a resistor which is connected in series with the primary winding 20 such that the actual primary winding current also flows through the current sensing resistor. The current sensing means produces a current sensing means output which varies with the actual primary winding current and which is conveyed to the comparing means by a resistor 58. In the preferred embodiment, the current sensing resistor has 0.1 ohms of resistance to produce a readily observable voltage while drawing relatively little power.

The reference current means 54 indicates the magnitude of the preselected maximum current. In the preferred embodiment, the reference current means 54 is a voltage divider made up of a resistor 60 connected with a positive reference potential and a pair of Zenor diodes 62 and 64 connected in series with ground. In the preferred embodiment, the diodes 62 and 64 each have a junction voltage of 0.43 volts. In this manner, a reference potential of 0.86 volts is produced which corresponds to a preselected current magnitude of 8.6 amps flowing through the 0.1 ohm resistor 52. By varying the magnitude of this reference potential or the size of the resistor 52, other maximum primary winding current magnitudes can be selected.

The comparing means 56 compares the preselected current magnitude with the sensed primary winding current magnitude or, more specific to the preferred embodiment, compares the reference potential with the potential across resistor 52. When the preselected current magnitude exceeds the sensed current magnitude, the comparing means 56 assumes a first comparator state which allows the switching means C to assume either its conductive or nonconductive states. When the sensed current magnitude meets or exceeds the preselected current magnitude, the comparing means 56 assumes a second comparator state which causes the switching means C to assume its nonconductive state. In the preferred embodiment, the comparing means 56 is connected by a diode 66 and a resistor 68 with capacitor 40. In its first comparator state, the comparing means produces a high output which rapidly charges the capacitor 40 sufficiently that the current regulating oscillator means 30 is caused to assume its first state which biases the switching means C to its nonconductive state. In the second comparator state, the comparing means output is low. However, the diode 66 prevents the low output of the comparing means in its second state from drawing potential from the capacitor 40. Alternately, the comparing means 56 may be connected directly with the switching means. For example, if the first comparator output were sufficiently negative, the switching means C would be biased to its nonconductive state regardless of the output of the current regulating oscillator means 30. If the second comparator state produced a low output, the low output could be summed through diode 66 with the oscillator means output and the state of the current regulating oscillator means 30 alone would control the switching means.

With reference to FIGS. 2A, B, and C, the functioning of the current regulating means D is illustrated in greater detail. At a time denoted $t_0$, the current regulating oscillator means 30 is depicted in FIG. 2A as switching from its first to its second state to commence producing its first or high output. This biases the switching means C to its conductive state which, as denoted in FIG. 2B, starts a flow of electrical current through the primary winding and the current sensing means C. The primary winding current magnitude increases linearly until it reaches the preselected current magnitude at $t_1$. When the sensed primary winding current magnitude meets the preselected current magnitude, the comparing means 56 assumes its first comparator state and, as denoted in FIG. 2C, produces a high output. This high comparator output rapidly charges capacitor 40 causing the current regulating oscillator means 30 to assume its first state. When the current regulating oscillator means 30 assumes its first state, the switching means C is biased to its nonconductive state stopping the primary winding current flow. Termination of the primary winding current results in the preselected current magnitude exceeding the actual primary winding current which causes the comparing means to return quickly to its second state. If the actual primary winding current had not exceeded the preselected current magnitude, at a time $t_2$ the current regulating oscillator means 30 would have returned to its second state on its own. At $t_3$, the cycle is repeated.

The average current reducing means E in the preferred embodiment has two states, one which reduces the average current and one which does not reduce the average current. Optionally, the average current reducing means D may assume one or more intermediate states or a continuum of intermediate states in response to a plurality of combustion conditions or a plurality of levels of the same combustion condition. The average current reducing means E includes a jack or lead 80 which is adapted to be connected with a combustion condition sensing means such as a flame detector or other conventional combustion condition sensing device. The combustion condition sensing means is connected with a comparator 82 by a voltage divider 84, 86. The comparator 82 eliminates transients and low level signals by comparing the output of the combustion condition sensor with the reference potential from the current reference means 54. When the preselected combustion condition is met, the comparator 82 allows a current reducing oscillator 90 to oscillate with a second frequency.

The current reducing oscillator 90 is of the substantially same design as the current regulating oscillator means 30. However, the magnitude of the components in the current reducing oscillator 90 are selected such that the second frequency is 60 hertz and the on:off duty cycle of 1:3. The current reducing oscillator includes a high gain amplifier 92 having its negative reference input connected with a capacitor 100 and a negative feedback resistor 102. The positive reference input of the high gain amplifier 92 is connected with a positive feedback resistor 104 and a voltage divider made up of resistor 106 and resistor 108. The current reducing oscillator is connected through diode 112 with capacitor 40 of the current regulating oscillator means 30. Each high pulse produced by the current reducing oscillator in its current reducing state charges the capacitor 40 locking the current regulating oscillator means 30 in its first state with biases the switching means C to its nonconductive state. Between each of the 60 hertz pulses, the current regulating oscillator means 30 functions normally. In the non-reducing state, the current reducing oscillator 90 produces a low output which is prevented by diode 110 drawing charge from capacitor 40. Optionally, the current reducing oscillator 90 may have a variable frequency or duty cycle which is varied in response to the level of the sensed combustion condition.

Exemplary circuit components are as follows:

| Resistor | Value (Ohms) |
|---|---|
| 39 | 1K |
| 42 | 33K |
| 44 | 15K |
| 45 | 100K |
| 46 | 100K |
| 48 | 100K |
| 52 | 0.1 |
| 60 | 100K |
| 68 | 1K |
| 84 | 100K |
| 86 | 100K |
| 102 | 1M |
| 104 | 100K |
| 104 | 100 |
| 106 | 47K |
| 108 | 100K |
| 110 | 1K |

| Capacitors | Value (mf) |
|---|---|
| 16 | .001 |
| 40 | .01 |
| 100 | .01 |

The invention has been described with reference to the preferred embodiment. Obviously, modifications and alterations will occur to others upon reading and understanding the preceding detailed description of the preferred embodiment. It is intended that the invention include all such modifications and alterations which come within the scope of the appended claims or the equivalents thereof.

Having provided a detailed description of the preferred embodiment, the invention is now claimed to be:

1. A multi-voltage ignition system comprising:

an ignition transformer having a primary winding which is adapted to be connected with a power supply and a secondary winding which is adapted to be connected with an ignition device;

switching means having current blocking and permitting states for blocking and permitting a flow of electrical current through the primary winding, the switching means being operatively connected with the primary winding;

an oscillator operatively connected with the switching means for cyclically causing the switching means to assume its current flow permitting and blocking states with a first frquency and a first duty cycle, such that the first frequency determines the periodicity with which current is permitted to flow and the first duty cycle determines a proportion of each first frequency cycle that current is permitted to flow;

current sensing means for sensing the magnitude of the primary winding current, the current sensing means being operatively connected with the primary winding; and, comparing means for comparing the sensed current magnitude with a preselected magnitude, said comparing means being operatively connected with said current sensing means and being operatively connected with the oscillator to shorten the first duty cycle such that the switching means blocks current flow when the sensed current magnitude meets or exceeds the preselected magnitude, whereby the primary winding current is held substantially below the preselected magnitude over a range of potentials supplied by the power supply.

2. The ignition system as set forth in claim 1 further including average current reducing means operatively connected with the oscillator for intermittently stopping the oscillator from oscillating such that the switching means is held intermittently in its blocking state, whereby the intermittent causing of the switching means to assume its blocking state reduces the average current flow through the primary winding.

3. The ignition system as set forth in claim 2 wherein said average current reducing means intermittently stops the oscillator with a second frequency, said first frequency being higher than said second frequency, whereby each cycle of the second frequency causes the switching means to assume its blocking state for a plurality of first frequency cycles.

4. An ignition system comprising:

an ignition transformer having a primary winding which is adapted to be connected with a power supply and a secondary winding which is adapted to be connected with an ignition device;

a switching means having a current blocking state and a current permitting state, the switching means being operatively connected with said primary winding to block and permit the flow of a primary winding current therethrough;

current regulating means operatively connected with said switching means for causing the switching means to assume its current blocking and current permitting states to regulate the primary winding current;

ignition condition sensing means for sensing a preselected ignition condition; and, a current reducing oscillator operatively connected with the ignition condition sensing means to oscillate with a second frequency in response to the sensed condition, the current reducing oscillator being operatively connected with the switching means to cause the switching means to assume its current blocking state for a preselected portion of each second frequency cycle, whereby the cyclic blocking of the primary winding current with the second frequency during the sensing of the preselected ignition condition reduces the average primary winding current.

5. The ignition system as set forth in claim 4 wherein said current regulating means includes a current regulating oscillator means which alternates with a first frequency at least between a first state in which it produces a first output for causing the switching means to assume said current blocking state and a second state in which it produces a second output for causing the switching means to assume said current permitting state, whereby the switching means alternately assumes its current permitting and current blocking states.

6. The ignition system as set forth in claim 5 wherein said second frequency is lower than said first frequency.

7. The ignition system as set forth in claim 6 wherein said current reducing oscillator in response to the sensed ignition condition intermittently with said second frequency blocks said current regulating oscillator means from assuming its second state, whereby the switching means is intermittently held in its current blocking state.

8. The ignition system as set forth in claim 7 wherein the current reducing oscillator blocks the current regulating oscillator means from assuming its second state about a quarter of the time.

9. The ignition system as set forth in claim 7 wherein said first frequency is about 4 kilohertz and said second frequency is about 60 hertz.

10. The ignition system as set forth in claim 5 wherein said current regulating oscillator means includes a capacitor whose charge and discharge rate controls said first frequency.

11. The ignition system as set forth in claim 10 wherein said average current reducing means is operatively connected with said capacitor for altering its charging or discharging rate, whereby the average current reducing means alters said first frequency.

12. The ignition system as set forth in claim 10 wherein said current reducing means is operatively connected with the capacitor for intermittently holding said capacitor in such a condition that said capacitor holds the current regulating oscillator means in its first state, whereby the switching means is held in its current blocking state.

13. The ignition system as set forth in claim 10 wherein said current regulating means includes a current sensing means for sensing the magnitude of the primary winding current and comparing means for comparing the sensed current magnitude with a preselected current magnitude, said comparing means being operatively connected with said capacitor for adjusting its charge when the sensed current magnitude meets or exceeds the preselected current magnitude in such a manner that the current regulating oscillator means assumes the second state, whereby the switching means blocks the primary winding current when its reaches the preselected current magnitude.

14. The ignition system as set forth in claim 5 wherein said current regulating means includes a current sensing means for sensing the magnitude of the primary winding current and comparing means for comparing the sensed current magnitude with a preselected current magnitude, said comparing means being operatively connected with said current regulating oscillator means for causing it to assume the second state when the sensed current magnitude meets or exceeds the preselected current magnitude, whereby the switching means blocks the primary winding current when it reaches the preselected current magnitude.

15. The ignition system as set forth in claim 14 wherein said switching means is a transistor having its base connected with the current regulating oscillator means.

16. The ignition system as set forth in claim 15 wherein said current sensing means is a resistor.

17. An ignition system for igniting fuel in heaters comprising:

a voltage regulator for producing a predetermined DC output voltage, said voltage regulator being adapted to be connected with a source of power;

an ignition transformer having a primary winding connected in series with said voltage regulator output and having a secondary winding connected with an igniter device for igniting the fuel;

switching means having current blocking and current permitting states connected in series with said primary winding for blocking and permitting a flow of electrical current through the primary winding;

a current regulating oscillator means which alternately assumes first and second states with a first frequency, said current regulating oscillator being operatively connected with said switching means such that the first and second states cause the switching means to assume its current blocking and permitting states, respectively;

current sensing means for sensing the magnitude of the primary winding current;

comparing means for comparing the sensed current magnitude with a preselected current magnitude, the comparing means in response to the sensed current magnitude meeting or exceeding the preselected current magnitude causing said current regulating oscillator means to assumes its first state such that the current regulating oscillator means causes the switching means to assume its current blocking state;

ignition condition sensing means for sensing a predetermined ignition condition;

average current reducing means operatively connected with the predetermined combustion condition sensing means, the average current reducing means including a current reducing oscillator which oscillates with a second frequency in response to the predetermined combustion condition, the second frequency being lower than the first frequency, the current reducing oscillator being operatively connected with the current regulating oscillator means to hold the current regulating oscillator means in its first state intermittently with the second frequency, whereby in response to the sensed combustion condition the average current reducing means intermittently with the second frequency causes the switching means to assume its current blocking state for a plurality of first frequency cycles intermittently with the second frequency thereby reducing the average primary winding current.

* * * * *

UNITED STATES PATENT AND TRADEMARK OFFICE

CERTIFICATE OF CORRECTION

PATENT NO. : 4,418,375

DATED : November 29, 1983

INVENTOR(S) : John W. Ober

It is certified that error appears in the above-identified patent and that said Letters Patent is hereby corrected as shown below:

Column 7, line 9, "frquency" should read -- frequency --.

Column 8, line 59, "its" should read -- it --.

Signed and Sealed this

*Seventh* Day of *August 1984*

[SEAL]

*Attest:*

GERALD J. MOSSINGHOFF

*Attesting Officer*

*Commissioner of Patents and Trademarks*